United States Patent [19]

Riehl

[11] 4,129,909

[45] Dec. 19, 1978

[54] BED STORAGE ARTICLE

[76] Inventor: Angela Riehl, 3420 Avenue J., Brooklyn, N.Y. 11210

[21] Appl. No.: 833,362

[22] Filed: Sep. 14, 1977

Related U.S. Application Data

[63] Continuation-in-part of Ser. No. 687,704, May 19, 1976, abandoned.

[51] Int. Cl.[2] ..... A47C 11/00

[52] U.S. Cl. ..... 5/317 R; 5/92; 5/324; 211/55; 248/1

[58] Field of Search ..... 5/92, 317 R, 318, 319, 5/324, 333; 150/1; 229/54 R; 248/1, 214; 211/55, 35; 224/42.11, 45 P

[56] References Cited

U.S. PATENT DOCUMENTS

| | | | |
|---|---|---|---|
| 1,738,557 | 10/1929 | Beiling | 248/1 |
| 2,061,302 | 11/1936 | Egler | 248/1 |
| 3,144,666 | 8/1964 | Mayera | 5/333 |
| 3,717,188 | 2/1973 | Green | 150/1 |

FOREIGN PATENT DOCUMENTS

| | | | |
|---|---|---|---|
| 106889 | 8/1965 | Norway | 5/317 R |

*Primary Examiner*—Casmir A. Nunberg
*Attorney, Agent, or Firm*—Robert D. Farkas

[57] ABSTRACT

An appliance adapted to engage the underside of the mattress of a bed and extend over the box spring, each extended end having pockets therein for the storage of bedroom articles.

3 Claims, 10 Drawing Figures

BED STORAGE ARTICLE

This is a continuation-in-part application of Ser. No. 687,704 filed on 05/19/76 now abandoned.

BACKGROUND OF THE INVENTION

This invention relates to a bedding storage appliance; more particularly, to an appliance that exhibits a pair of oppositely disposed pockets on each side of a bed for storage.

U.S. Pat. No. 3,120,721, issued Feb. 11, 1964, to B. Bukatman, et al. teaches a bedspread having toy devices disposed on the uppermost lateral surfaces and the surfaces of the spread suspended vertically downwardly from the uppermost regions of a mattress. Bukatman displays a plurality of pocket-like assemblies secured to the vertical portions of the apparatus adapted to have disposed therewithin, various articles. This teaching fails to provide an apparatus suitable for using the bed, as a sleeping device, as a supporting device while sleeping, because such apparatus covers the surface of the mattress ordinarily slept thereon.

U.S. Pat. No. 2,904,798 issued Sept. 22, 1959 to W. G. Heflin, discloses a hospital bed with multipurpose equipment including a drawer-like assembly secured to a pair of rails disposed underneath the mattress supporting spring such that the drawer may be disposed outwardly from under the spring along the elongated maringal edges of the mattress. Such apparatus is useful for storing equipment normally associated with hospital confined patients but fails to provide a soft flexible apparatus, of inexpensive nature, which can be disposed intermediate a conventional unaltered mattress and box spring assembly.

U.S. Pat. No. 2,562,443, issued July 31, 1951, to R. D. Barbour et al. describes an ashtray and glass holder attachment for tables having a rigid-like element, in wire-like form disposed resting on the corner of a flat table to which a pair of glass holding frames are secured. A portion of the joining apparatus, joining the glass holding attachment stand the leg of the table. Such apparatus, though utilizing a horizontal supporting surface having two pocket-like receivers on each end thereof, is totally rigid and would be ineffective for purposes of providing an under support for a mattress.

SUMMARY OF THE INVENTION

It is accordingly an object of the instant invention to provide for a bedding storage member as aforedescribed.

It is another object to provide for a bedding appliance that requires no mechanical hook-up to a bed.

It is a further object to provide for the same at relatively little cost thereby making it generally available.

These and other objects and advantages of the invention will become more apparent from the following detailed disclosure and claims and by reference to the accompanyind drawings, in which:

Figure 1:
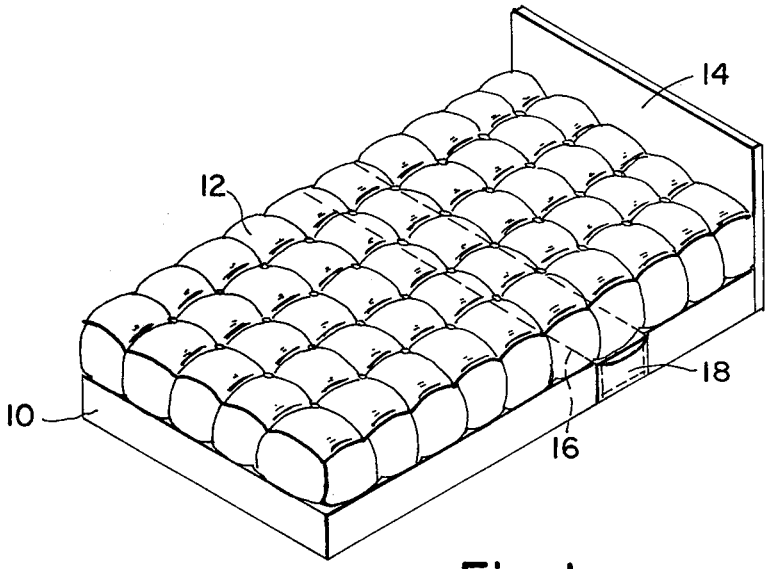
FIG. 1 is a perspective view.
Figure 2:
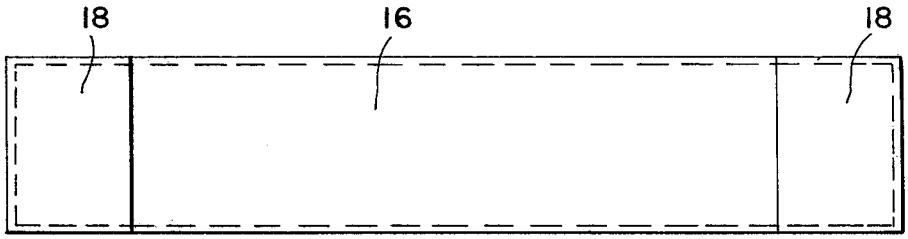
FIG. 2 is a planar top elevational view of the invention.

Broadly speaking, the instant invention includes the provision of a bedding storage article adapted to be disposed between the mattress and mattress supporting member of a bed, comprising an elongated rectangular sheet having a length at least as great as the width of the mattress, at least one pair of pockets each individually disposed at opposite distal ends of the member, the pockets being substantially perpendicular to the member.

DETAILED DISCLOSURE

Referring more particularly to the drawings, there is shown a conventional bed that includes a box spring at base 10, mattress 12 and optionally, a head board 14. Generally, the mattress 12 is separable from the lower member 10, such that the instant invention may be disposed therebetween.

The instant invention includes a generally planar center member 16 that may be rigid or flexible, though the latter is preferred. The length thereof is at least as great as the width of a bed, be it single, twin, double, etc. Each distal end of the member 16 will include a pocket or sack 18 thereat. The pockets 18 being adapted to lie parallel to the side of the member 10 and be in contact therewith while at the same time being substantially perpendicular to the member 16. The member 16 being transverse the longitudinal axis of the mattress 12. The instant invention in use reflecting a U-shaped configuration in juxtaposition between the mattress 12 and the member 10.

Figure 4:
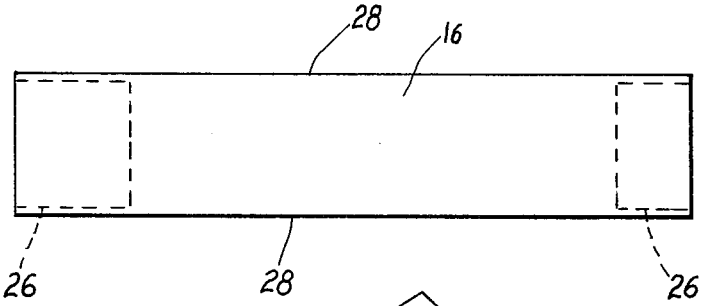
FIG. 4 is a plan view of another embodiment of the present invention.

A generally planar center member 16, is always narrower than the length of the mattress on which it is supported, and thus always narrower than the length of the spring or mattress apparatus therebelow. Flaps 20, shown in FIG. 4, are extensions of center member 16, and are disposed on surface 22, by folding about line 24. The unitary apparatus is provided by utilizing stitches, shown in dotted lines 26, disposed extending parallel to elongated marginal edges 28. In this embodiment, all the material comprising center member 16 and flap member 20, is flexible fabric-like in nature.

Figure 5:
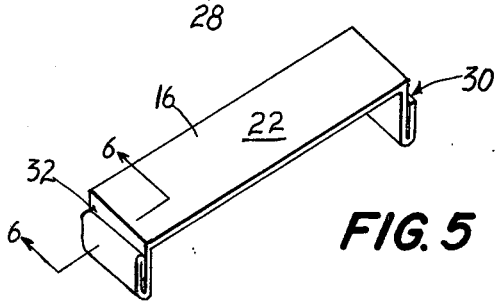
FIG. 5 is a perspective view of the apparatus shown in FIG. 4.

FIG. 5 illustrates uppermost surface 22, shown extending over flap portions 20. Flap portions 20 define mouth portions 30 which extend over flap 20 and intermediate side walls 32. The interior surfaces 34 are adapted to rest upon the side walls of a mattress supporting structure such as a box spring, not shown. Thus, applying downward force on surface 22, meets little resistance, and permits a user, not shown, while resting on a mattress, not shown, thereabove, to sleep comfortably. It should be noted, that the apparatus shown in FIG. 5, contains a pair of pockets whose open mouth portion is disposed adjacent to the side walls of a mattress supporting surface, but having portions 32 of surface 22 disposed thereinbetween.

Figure 6:
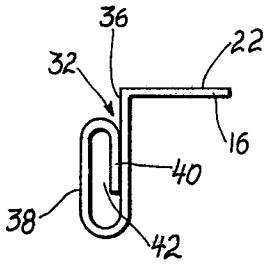
FIG. 6 is a side elevation cross-sectional view of an alternate construction of a portion of the apparatus shown in FIG. 5, taken along line 6—6, shown in the direction of arrows 6—6.

FIG. 6 illustrates another embodiment of portions 32 of center member 16, having an open mouth portion 36 defined by exterior leg 38 and interior leg 40. It is to be noted that leg 40 comprises the same material as exterior leg 38 and portion 32 and center member 16. Cavity 42 is disposed between adjacent surfaces 38 and 40 and may be used for the storage of articles by passage of such articles through open mouth portion 36 and intermediate adjacent surfaces of leg 40 and portions 32. Thus, small children, and other unauthorized persons, may not readily have access to articles stored within cavity 42. Dotted lines 26 shown in FIG. 4, are used to reflect stitches, usable in the same manner as shown in FIG. 4, to secure the edges of legs 48 and 40, alongside the elongated marginal edges of the apparatus depicted in FIG. 8. It should also be noted that legs 38 and 40 and portion 36, as well as member 16, comprise a unitary structure. If desired, the other end of member 16, not shown, may be fitted with a pocket of the type shown in FIG. 6, or if desired, of the type shown in FIG. 5.

Figure 3:
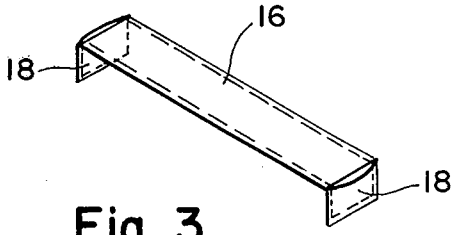
FIG. 3 is a perspective top elevational view.
Figure 7:
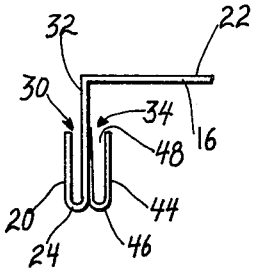
FIG. 7 is still another alternate embodiment of the apparatus shown in FIG. 5.

FIG. 7 illustrates member 16 having portion 32 thereof disposed adjacent flap 20. Flap 20 and portions 32 and member 16 are unitary in constructin. Flap 44 is shown having end 36 thereof, secured to interior surface 34, so as to provide an open mouth portion 48, disposed extending substantially parallel to open mouth 30. The configuration of the pocket-like end of center member 16, shown in FIG. 7, may be utilized at the other end of center member 16, not shown, or if desired, the pocket-like configuration shown in FIGS. 5, 6, and 3 may be utilized.

Figure 8:
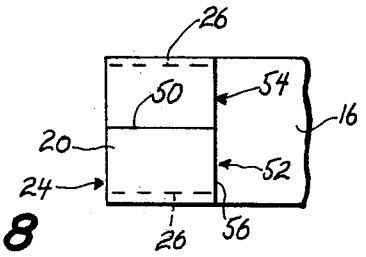
FIG. 8 is a portion of a plan view of yet another embodiment of the apparatus shown in FIG. 4.

FIG. 8 illustrates flap 20 shown secured to center member 16 and utilizing stitches, depicted by dotted lines 26, and by solid line 50, so as to provide open mouth portions 52 and 54, disposed adjacent marginal edge 56 of flap 20. Thus, the apparatus shown in FIG. 8 depicts an unitary structure having a pair of pockets disposed in side by side relationship, and having a pair of open mouth portions thereof, disposed adjacent to each other.

Figure 9:
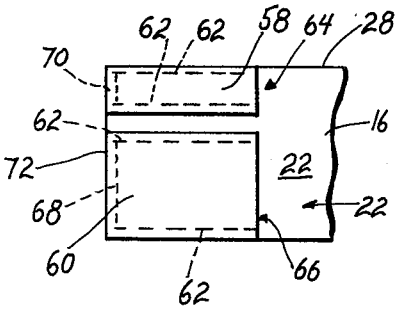
FIG. 9 is a portion of a plan view of still another alternate embodiment of the apparatus shown in FIG. 4.

FIG. 9 illustrates center member 16 shown having a fabric-like member 58 secured to surface 22 thereof, and another fabric-like member 60, similarly secured but spaced apart from member 58, each utilizing stitches, depicted by dotted lines 62 therefor. Stitches 62 extend parallel to elongated marginal edges 28 and provide open mouth portions 64 and 66. Dotted lines 68 and 70 depict stitches extending adjacent marginal edge 72, of center member 16, thus enabling member 16 to form one side wall of a pocket and enabling member 58 to similarly serve as a pocket. In FIG. 9, center member 16, and members 58 and 60 are independent of one another and are fabricated from a flexible fabric-like material.

Figure 10:
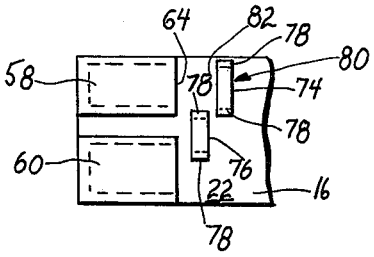
FIG. 10 is a partial plan view of a further embodiment of the apparatus shown in FIG. 4.

FIG. 10 illustrates center member 16, shown carrying fabric-like members 58 and 60, in similar fashion, to such members as shown in FIG. 9. Elongated strap-like members 74 and 76 are shown secured by stitching, illustrated by dotted lines 78, extending along the short edges thereof, so as to provide loop-like members through which elongated articles, such as pencils, nail files, hair treatment devices or the like, may be stored between such strap-like members and surface 22 of center member 16. It should be noted that strap-like member 74 is disposed residing adjacent open-mouth portion 64 of the pocket formed partially by member 68, while strap member 68 is shown extending between members 58 and 60. Thus, longer articles, such as pencils, may be stored within the pocket defined by member 58 and the loop defined by member 74. Such loop is provided having open mouth portions 80 and 82, such that an elongated article, not shown, can pass between adjacent surfaces of strap 74 and surface 72, having one end thereof disposed within the pocket formed by member 58 and by passing through open mouth portion 64. Such pockets and loops, described in FIG. 10 or in FIG. 9, may each be installed on either end of an elongated center member 16, so as to provide an inexpensive flexible surface for resting on a mattress supporting surface and extending outwardly from the elongated edges thereof. It should be noted that the apparatuses shown in FIGS. 9 and 10 each contain separable component parts, such as members 58, 60, and straps 74 and 76. However, members 58 and 60 may be replaced by flap 20, shown in FIGS. 4, 5, and 8, if desired, or alternatively, members 58 and 60 may be supplanted by a flap 20 shown in FIG. 5, and provided having straps 74 and 76 used in conjunction therewith.

Since it is obvious that numerous changes and modifications can be made in the above-described details without departing from the spirit and nature of the invention, it is to be understood that all such changes and modifications are included within the scope of the invention.

I claim:

1. A bedding storage article for use with a mattress and a mattress supporting member of a bed, comprising an elongated rectangular fabric-like sheet, said sheet having a length at least as great as the width of said mattress, said sheet having a width less than the length of said mattress, said sheet including a pair of portions adjacent the ends thereof, said pair of portions extending outwardly and downwardly from a lowermost lateral surface of said mattress when said mattress is disposed juxtaposed resting on an equisized supporting member and when the remaining portion of said sheet is disposed residing on an uppermost lateral surface of said mattress supporting member, a first portion of each of said pair of portions being disposed having a U-shaped cross section, a second portion of each of said pair of portions contiguous with and extending adjacent to one free end of one leg of said U-shaped cross section, the free end of said second portion being disposed intermediate the legs of said U-shaped cross section, means to secure said first portion and said second portion of said each of said pair of portions adjacent the marginal edges thereof defining a pocket having said free end of said second portion forming an entranceway into an interior pocket, said pocket having an open mouth portion, said open mouth portion being disposed intermediate said remaining portion and said legs of said U-shaped cross-section, wherein said pair of portions and said remaining portion comprise a unitary structure.

2. The apparatus as claimed in claim 1 further comprising a strap, means to secure said strap to said one of said pair of portions, said strap being flexible and fabric-like and defining a pair of opposed open mouth portions, said pair of opposed open mouth portions being disposed located intermediate said remaining portion and said open mouth portion.

3. The apparatus as claimed in claim 1 further comprising a fabric-like sheet, means to secure said fabric-like sheet, adjacent a portion of the marginal edges thereof to said each of said pair of portions defining another pocket, said another pocket having another open mouth portion, said another open mouth portion being disposed intermediate said remaining portion and the distal end of said each of said pair of portions to which it is secured.

* * * * *